US008047122B1

(12) United States Patent
Trent et al.

(10) Patent No.: US 8,047,122 B1
(45) Date of Patent: Nov. 1, 2011

(54) TENSIONER ASSEMBLY WITH MULTIPLE CYLINDER STROKE SYSTEM

(75) Inventors: David Trent, Cypress, TX (US); Michael Jacob Gross, Houston, TX (US); Charles Clarence Trent, San Antonio, TX (US)

(73) Assignee: Drilling Technological Innovations, Houston, TX (US)

( * ) Notice: Subject to any disclaimer, the term of this patent is extended or adjusted under 35 U.S.C. 154(b) by 0 days.

(21) Appl. No.: 12/814,737

(22) Filed: Jun. 14, 2010

(51) Int. Cl.
*F01B 31/12* (2006.01)

(52) U.S. Cl. ..... 92/5 R

(58) Field of Classification Search ..... 92/5 R, 92/143; 91/1
See application file for complete search history.

(56) References Cited

U.S. PATENT DOCUMENTS

| | | | | |
|---|---|---|---|---|
| 3,804,183 | A * | 4/1974 | Duncan et al. | 175/5 |
| 4,351,261 | A * | 9/1982 | Shanks | 114/264 |
| 5,209,302 | A * | 5/1993 | Robichaux et al. | 166/355 |
| 6,484,620 | B2 * | 11/2002 | Arshad et al. | 92/5 R |
| 6,710,327 | B2 * | 3/2004 | Arshad et al. | 250/227.11 |
| 6,769,349 | B2 * | 8/2004 | Arshad et al. | 92/5 R |
| 6,817,422 | B2 * | 11/2004 | Jordan | 166/381 |
| 7,316,176 | B2 * | 1/2008 | Dunn et al. | 92/5 R |
| 7,588,393 | B1 * | 9/2009 | Shivers et al. | 405/224.4 |
| 7,654,327 | B1 * | 2/2010 | Shivers et al. | 166/345 |

* cited by examiner

*Primary Examiner* — Michael Leslie
(74) *Attorney, Agent, or Firm* — Buskop Law Group, PC; Wendy Buskop

(57) ABSTRACT

A tensioner assembly with a hydraulic fluid and gas is described herein. The tensioner assembly can accurately and reliably detect the position of a cylinder rod in each cylinder of the assembly by using a laser. The data obtained from the laser can be reliable and dependable regardless of any powders, oil, particulate, or scratched lenses of the camera.

18 Claims, 9 Drawing Sheets

TENSIONER ASSEMBLY WITH MULTIPLE CYLINDER STROKE SYSTEM

FIELD

The present embodiments generally relate to a tensioner assembly that can provide a highly accurate and highly reliable determination of the location of a cylinder rod in a tensioner assembly, such as during withdrawal or extension of the cylinder rod from the cylinder.

BACKGROUND

A need exists for an accurate tensioner assembly that can determine the position of a piston portion of a cylinder rod with an accuracy of 0.01 of an inch.

A further need exists for a rugged seaworthy tensioner assembly that can be used for supporting oil platforms and that can accurately detect the location of the cylinder rod, thereby preventing oil spills, tilting of the platform, and accidents on offshore oil rigs.

The present embodiments meet these needs.

BRIEF DESCRIPTION OF THE DRAWINGS

The detailed description will be better understood in conjunction with the accompanying drawings as follows.

Figure 1:
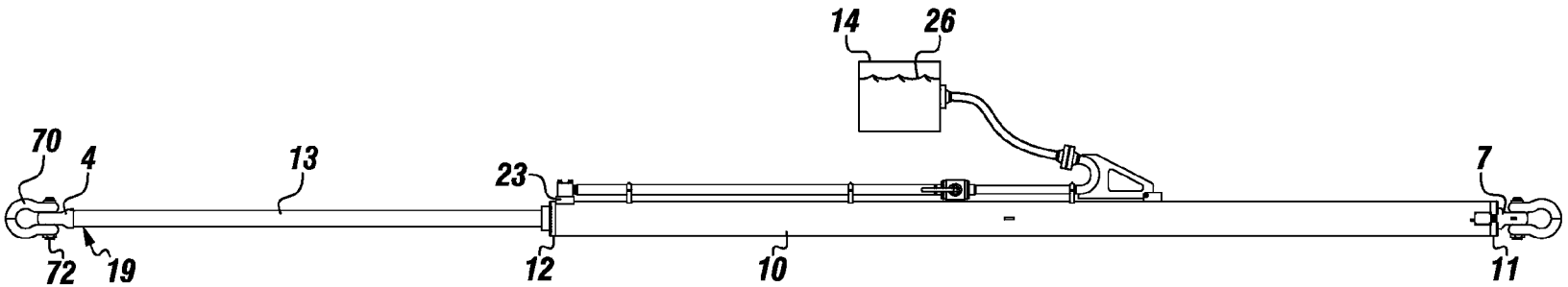
FIG. 1 is a side view of a pressure containing tube for tensioning a structure.

The present embodiments are detailed below with reference to the listed Figures.

DETAILED DESCRIPTION OF THE EMBODIMENTS

Before explaining the present assembly and method in detail, it is to be understood that the assembly and method are not limited to the particular embodiments and that the assembly and method can be practiced or carried out in various ways.

The present embodiments relate to a tensioner assembly. The tensioner assembly can include or can use a pressure containing tube with a first tube end and a second tube end.

One or more embodiments of the tensioner assembly can include a plurality of cylinder stroke systems.

A first fluid source regulator can control or regulate fluid flow from a first fluid source to each of the cylinder stroke systems. The first fluid source regulator can be a valve, a pump, or another fluid flow regulator.

A fluid source controller can control the first fluid source regulator. The fluid source controller can include a fluid flow processor. The fluid flow processor can be in communication with a fluid source data storage. The fluid source data storage can have computer instructions to regulate the flow of a first fluid to and from a plurality of connected accumulators based on preset stroke limits for each cylinder rod in each pressure containing tube. The plurality of accumulators can be connected in series.

A gas source can be connected to the first fluid source. The gas source can be one or more tanks of inert gas. For example, the gas source can be a plurality of gas cylinders connected in series.

A gas source regulator can be connected between the first fluid source and the gas source. The gas source regulator can control or regulate gas flow from the gas source to at least one of the plurality of accumulators. The gas source regulator can be a valve.

In one or more embodiments, each cylinder stroke system can include a pressure containing tube. The pressure containing tube can have a first tube end and a second tube end. A cylinder rod can be movably disposed within the pressure containing tube. Each cylinder rod can have a cylinder rod first end and a cylinder rod second end.

Each cylinder stroke system can also include a piston. The piston can be disposed on the cylinder rod first end. The piston can have an outer diameter providing a sliding fit with an inner diameter of the pressure containing tube. The piston can be fixed to the cylinder rod.

A first fluid port can be formed in each pressure containing tube. The first fluid port can be in fluid communication with the first fluid source and can provide a first fluid to the pressure containing tube adjacent to the cylinder rod. In one or more embodiments the first fluid source can include a plurality of connected accumulators. A second fluid can be disposed within each pressure containing tube.

Each cylinder stroke system can include a blind end cap and mount. The blind end cap and mount can have a cap portion connected to the first tube end. The blind end cap and mount can have a mount portion connected to the cap portion. In one or more embodiments the mount portion can connect to a component of a floating vessel linked to a subsea well.

Each cylinder stroke system can include a laser, which can be secured to the pressure containing tube. The laser can be in communication with a laser controller. The laser can generate a beam. The beam can be reflected by another portion of the cylinder stroke system. For example, the beam can be reflected by the piston.

At least one optic guide can be disposed through the first tube end. The optic guide can be used to direct the beam from the laser through the second fluid to contact the piston. A lens can separate the optic guide from the second fluid. A pressure isolation flange can be used to connect the optic guide to the laser.

The laser controller can be in communication with a camera. In one or more embodiments, the camera can be in communication with a main controller in lieu of or in conjunction with the laser controller. The camera can capture the reflection of the beam from the piston and can convert the reflection into a reflection signal. The reflection signal can be transmitted to the main controller to determine a position of the cylinder rod in the pressure containing tube. The position of the cylinder rod can be determined with an accuracy from about 0.1 percent to about 2 percent of at least one calibration baseline of the beam in view of any particulate or oil buildup on the lens or in the second fluid.

The pressure containing tube can have a length from about 1 meter to about 30 meters, and an inner diameter from about 0.1 meter to about 0.8 meters.

A cylinder rod can move in and out of one side of the pressure containing tube. The cylinder rod can have a cylinder rod first end and a cylinder rod second end. In embodiments, the cylinder rod can be a hollow steel tube.

The cylinder rod can have an outer diameter in proportion to the length of the pressure containing tube that can range from about 1:60 rod diameter to tube length to about 1:24 rod diameter to tube length. The length of the cylinder rod can be from about 40 percent to about 60 percent the overall length of the pressure containing tube.

A cylinder head can connect to the second tube end and can allow the cylinder rod to moveably pass through the cylinder head.

A cylinder head seal can be disposed adjacent the cylinder head within the pressure containing tube, for sealing any fluid disposed in the pressure containing tube around the cylinder rod in the tube, preventing any leakage. The cylinder head seal can be formed in part from an elastomeric material, a synthetic rubber, a natural rubber, a metal, or combinations thereof. For example, the cylinder head seal can be a rubber coated metal disc.

The piston can be disposed on the cylinder rod first end to provide a barrier between the first fluid in the pressure containing tube and the second fluid in the pressure containing tube, thereby isolating the second fluid from the first fluid.

A first fluid port can allow the first fluid to flow from a first fluid source, such as a tank, into the pressure containing tube. This first fluid can flow into the pressure containing tube and around the cylinder rod.

The second fluid can be disposed within the pressure containing tube on the side of the pressure containing tube opposite the side containing the cylinder rod. The second fluid can be isolated from the first fluid by the piston.

The first fluid can be a hydraulic fluid, a hydraulic oil, air, or an inert gas. The second fluid can be compressible, such as a gas or a vapor, or an inert gas, such as nitrogen, helium, or argon.

A blind end cap and mount can be affixed to the first tube end. The blind end cap and mount can have two components, including a cap portion having a hole for mounting and a mount portion attached to the cap portion. The mount portion can engage the first tube end. In embodiments, the mount portion can have a diameter larger than the cap portion. In embodiments, the blind end cap and mount can be a one-piece construction made from a rigid and durable material, such as steel.

A laser can be mounted to the pressure containing tube. The laser can be use to generate a beam. A camera can be mounted adjacent to the laser. The laser and the camera can be protected by a laser housing for resistance to impacts and water. In embodiments, the laser can be mounted parallel to the pressure containing tube.

The laser can produce a beam that can pass through at least one optic guide. In embodiments, three optic guides can be used along with the second fluid of the pressure containing tube to provide contact of the beam with the piston and to cause a reflection that can be captured by the camera. The reflection can pass back through the optic guides to the camera.

The camera can be in communication with a main controller, a laser controller, or combinations thereof. The camera can convert the reflection into a reflection signal, which can be transferred to the main controller.

The main controller and/or the laser controller can include computer instructions to determine a position of the cylinder rod in the pressure containing tube with an accuracy between 0.1 percent to 2 percent of at least one calibration baseline of the beam in view of any particulate or oil buildup on the lens or in the second fluid.

The laser controller can adjust the beam in view of preset data for the cylinder rod and can change the beam to improve accuracy of the reflection signal. The preset data can be a plurality of preset velocities.

At least one optic guide can be disposed through the cap portion for directing the beam from the laser through the second fluid to contact the piston and cause the reflection.

A lens can be used at the end of the optic guide adjacent the second fluid, thereby separating the optic guide from the second fluid.

In embodiments, the laser housing can be disposed about the laser and the camera. The laser housing can be formed from steel, a reinforced composite, or a polymer to provide water-resistance and explosion-resistance for the laser and the camera. The laser housing can have water resistant at depths up to 30 meters under water.

The laser housing can have an interface plug for connecting the laser and the camera in the housing with the main controller.

The main controller can have computer instructions in a data storage for instructing a processor to compare the reflection signal to a preset velocity and to use cylinder rod data in the data storage to determine a position of the cylinder rod in the stroke cycle relative to the pressure containing tube.

The optic guide or plurality of optic guides can each be at least partially contained within an optic guide housing. The optic guide housing can be disposed about the optic guide. At least part of the optic guide can be disposed in the mount of the blind end cap and mount. At least part of the optic guide can be external to the pressure containing tube.

A first optic guide can guide the beam from the laser to a first redirectional surface. The first re-directional surface can be a mirror, a prism, a reflective plate, or another surface that can redirect the beam at an angle, such as a 90 degree angle.

A second optic guide can then direct the re-directed beam to a second redirectional surface, which can be a prism, mirror, reflective plate, reflective lens, steel plate, gold coated plastic plate, or a similar material. The second optic guide can accurately redirect the laser beam at an angle, such as an angle from about 120 degrees to about 60 degrees.

The optic guides can have different diameters. The diameter of each optic guide can be wide enough to accommodate the beam, such as a diameter from about 12 mm to about 75 mm.

The twice redirected beam can be guided through a third optic guide to a lens, which can be supported by a lens retainer and encircled by a vapor diverter. The vapor diverter can be attached around one of the optic guides adjacent the lens for receiving any particles suspended in the second fluid.

The twice re-directed beam can enter the second fluid and contact the piston, which forms the reflection. The reflection can pass back through the lens, through the redirectional surfaces and optic guides, and to the camera adjacent the laser.

In embodiments, the camera can be spaced apart from the laser. For example, the camera can be disposed proximate to the lens.

In one or more embodiments, at least one re-directional surface can be disposed between any two optic guides.

In one or more embodiments, the beam can have a constant frequency that can be calibrated using a harmonic diagnostic procedure that can adjust to a composition of the second fluid. For example, the beam can have a constant frequency that can be calibrated using computer instructions for providing harmonic diagnostic procedures that adjust to a composition of the second fluid. The computer instructions can be stored in the laser controller.

The main controller can have a power supply, such as a rechargeable battery supply or a connection to a reliable 110 volt source. The main controller con have a user interface display connected to the power supply, a circuit board connected to the user interface display and the power supply, and a processor connected to the circuit board.

The main controller can have a data storage in communication with the processor. The data storage can have computer instructions to compare a current value representing the reflection to a preset value associated with a stroke distance for the cylinder rod in the pressure containing tube to determine a position of the piston in the pressure containing tube. Additional computer instructions within the main controller can be used for comparing the reflection signal to preset velocities for the cylinder rod.

One or more embodiments relate to a method for tensioning an offshore platform by using a cylinder stroke system with a laser proximity detector.

The method can include calibrating the laser to determine a limit of a fully extended cylinder rod in a pressure containing tube of a cylinder stroke system.

Next, the laser can be calibrated to determine a limit of a fully retracted cylinder rod in the pressure containing tube.

After calibration, a beam can be projected from the laser through at least one optic guide and through a lens to a piston connected to the cylinder rod. The beam, upon contacting the piston, can form a reflection, which can travel back through the lens and optic guide to a camera associated with the laser. The camera can convert the reflection to a reflection signal, which is also termed herein a "current value". The camera can transmit the current value to the main controller.

The method can include using computer instructions in a data storage of the main controller to instruct the processor to compare the current value to a preset value associated with a stroke distance for the cylinder rod in the pressure containing tube to determine a position of the piston in the pressure containing tube.

The method can include using additional computer instructions in the main controller data storage to instruct the processor to use harmonics with the beam to correct the reflected signal based on characteristics of the piston, forming a corrected reflected signal. For example, the method can include using harmonics with the reflected signal to accommodate for surface characteristics of the piston, forming the corrected beam.

The method can include using computer instructions in the data storage of the main controller to change a frequency or a pulse width of the beam using on the corrected reflected signal.

The method can be used to determine cylinder rod positions for cylinder rods at velocities up to 10 meters per second.

In embodiments, the main controller can be in communication with a plurality of client devices through a network, such as the Internet™, a satellite network, a cellular network, or combinations thereof, thereby providing for simultaneous remote monitoring of the cylinder.

One or more embodiments can include two lasers on a single pressure containing tube to further ensure safety of the offshore drilling platform if one of the lasers fails during operation.

In operation, the first fluid can flow through the first fluid port and into the pressure containing tube. The first fluid within the pressure containing tube can exert a pressure upon the piston, thereby moving the piston in a first direction towards the portion of the pressure containing tube containing the second fluid and the laser proximity detector. The movement of the piston can cause a corresponding movement of the cylinder rod in the first direction. The movement of the cylinder rod can cause a corresponding movement and/or tensioning of equipment that is connected to the cylinder rod, such as at the shackle pin of the cylinder rod. When the pressure of the second fluid within the pressure containing tube is greater than the pressure of the first fluid within the pressure containing tube, the piston can move in a second direction, wherein the second direction can be opposite the first direction. During operation and movement of the piston, the cylinder rod, and any equipment connected thereto, the laser can continually, continuously, or periodically transmit a beam to the piston, cylinder rod, or another portion of the assembly to determine the position of the piston, cylinder rod, or equipment connected thereto.

FIG. 1 is a perspective view of a pressure containing tube 10 for tensioning a structure. The pressure containing tube 10 can have a first tube end 11 and a second tube end 12.

A cylinder rod 13 can extend from the second tube end 12. A cylinder rod second end 19 can connect to a first blind end cap and mount 4. The first blind end cap and mount 4 can engage a shackle 70 secured to the cylinder rod second end 19 with a shackle pin 72.

The first tube end 11 can engage a second blind end cap and mount 7.

A first fluid 26 from a first fluid source 14 can flow into the pressure containing tube 10 through a first fluid port 23.

Figure 2:
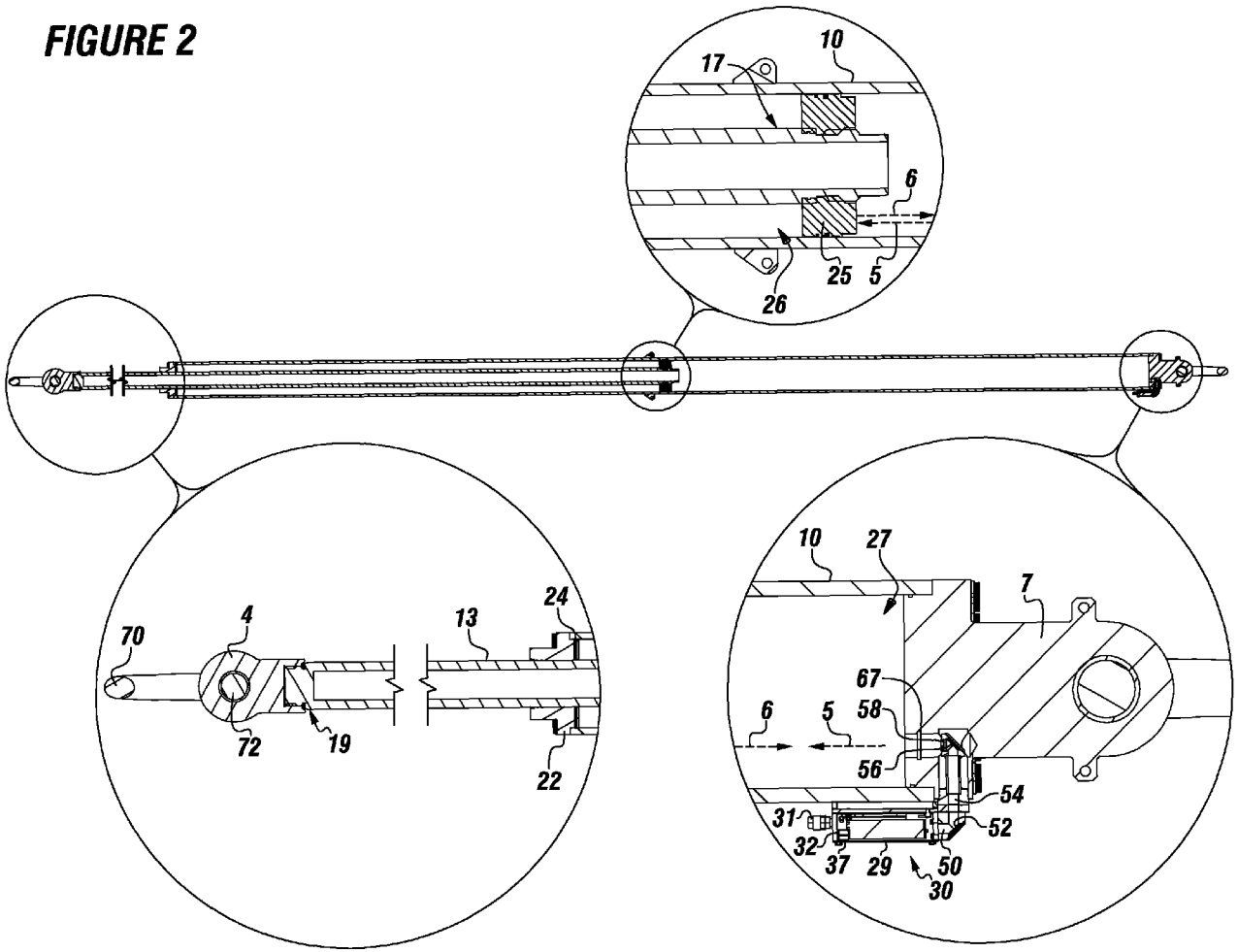
FIG. 2 is a cross sectional view of the pressure containing.

FIG. 2 is a cross sectional view of the pressure containing tube 10.

The cylinder rod 13 can have a cylinder rod first end 17 that can engage a piston 25. The cylinder rod first end 17 can support the piston 25.

A second fluid 27 can be separated from the first fluid 26 by the piston 25 and the cylinder rod 13.

The pressure containing tube 10 can have a cylinder head 22 and a cylinder head seal 24 for providing a leak-free engagement with the cylinder rod 13 during operation with a hydraulic fluid or a pneumatic gas.

The second blind end cap and mount 7 can have a hole 46 that can engage a shackle pin.

A laser 30 can connect to the second blind end cap and mount 7 and to a wall of the pressure containing tube 10. The laser 30 can have a camera 37 inside a laser housing 29 that can have an interface plug 31, allowing the laser to communicate to a main controller. A laser controller 32 can be disposed within the laser housing 29.

A beam 5 from the laser 30 can cause a reflection 6 at the piston 25. The beam 5 can pass from the laser 30, through a first optic guide 50, to a first re-directional surface 52, through a second optic guide 54, to a second re-directional surface 56, through a lens 58, and out into the second fluid 27. The lens 58 can be surrounded by a vapor diverter 67. The optic guides can be housed in the mount portion of the second blind end cap and mount 7.

Figure 3A:
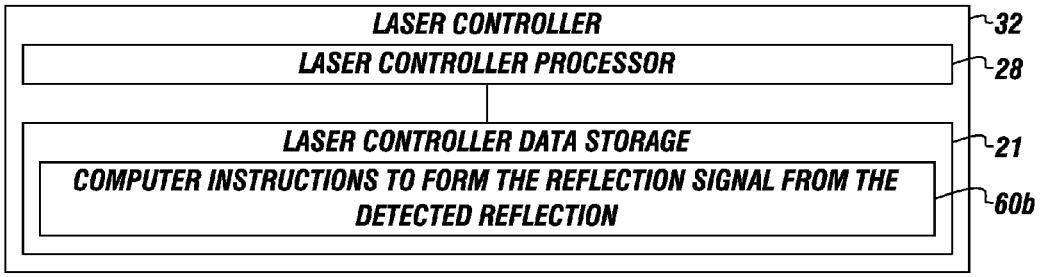
FIG. 3A is a detail of a laser controller.

FIG. 3A shows a detail of the laser controller 32. The laser controller 32 can have a laser controller processor 28 and a laser controller data storage 21 with computer instructions 60*b* to form the reflection signal from the detected reflection.

Figure 3B:
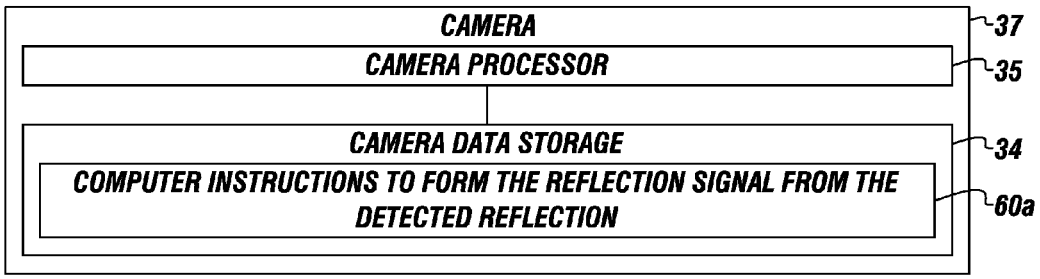
FIG. 3B is a detail of a camera.

FIG. 3B shows a detail of the camera 37. The camera 37 can have a camera processor 35 and a camera data storage 34 in communication with the camera processor 35. The camera data storage 34 can have computer instructions 60*a* to form the reflection signal from the detected reflection.

Figure 4:
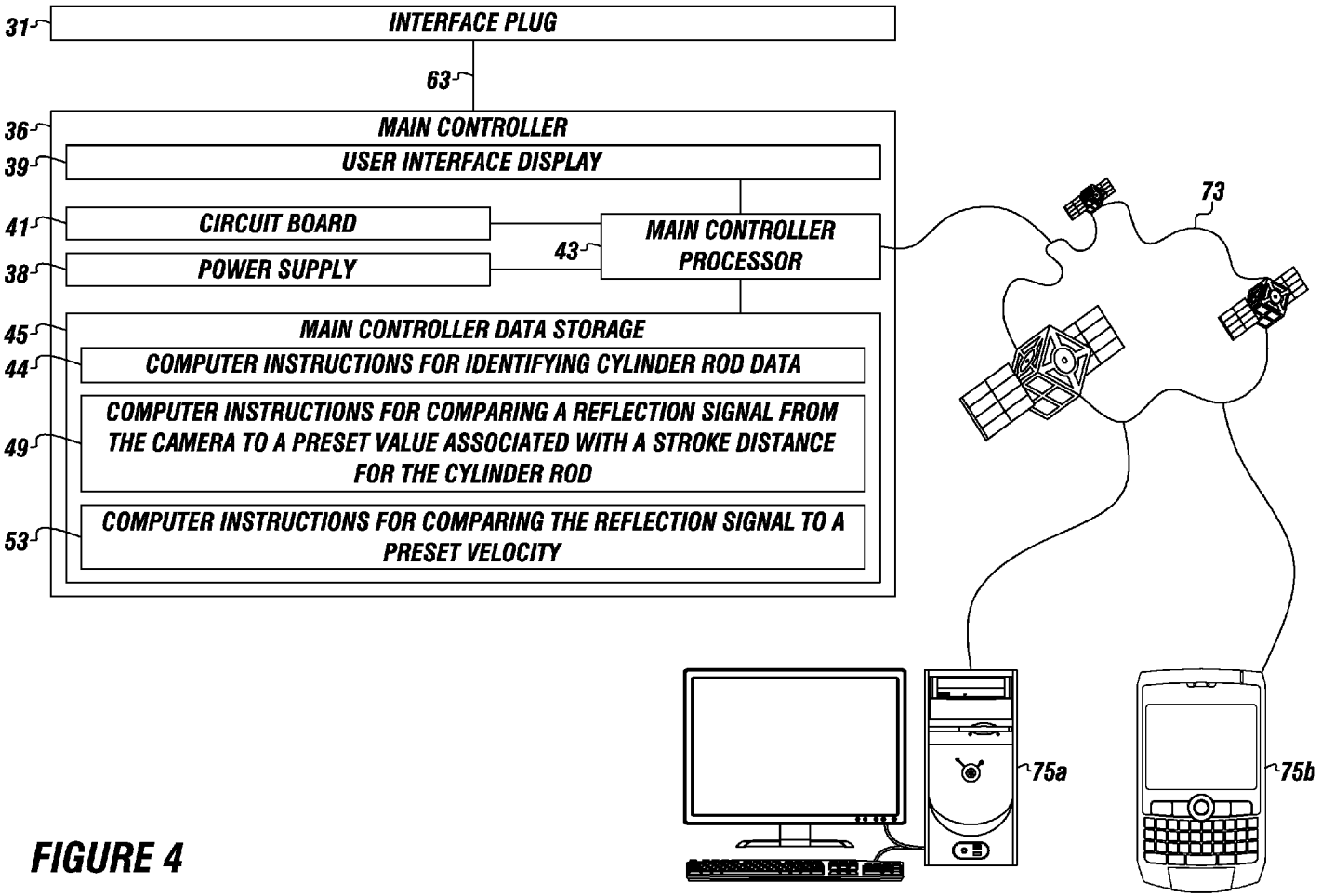
FIG. 4 is a detail of the main controller.

FIG. 4 shows a detail of the main controller 36 connected to the laser through the interface plug 31.

The main controller 36 can have a power supply 38 for operating a main controller processor 43, a circuit board 41, and a user interface display 39.

The main controller processor 43 can be in communication with a plurality of client devices 75*a* and 75*b* through a network 73, allowing for continuous, 24 hours a day, updated communication to remote locations concerning the status of each cylinder and stroke.

The main controller 36 can have a main controller data storage 45 with computer instructions stored therein. The main controller 36 can receive a reflection signal 63 from the camera, the laser, or combinations thereof through the interface plug 31.

The main controller data storage 45 can have computer instructions for identifying cylinder rod data 44, computer instructions for comparing a reflection signal from the camera to a preset value associated with a stroke distance for the cylinder rod 49, and computer instructions for comparing the reflection signal to a preset velocity 53.

Figure 5:
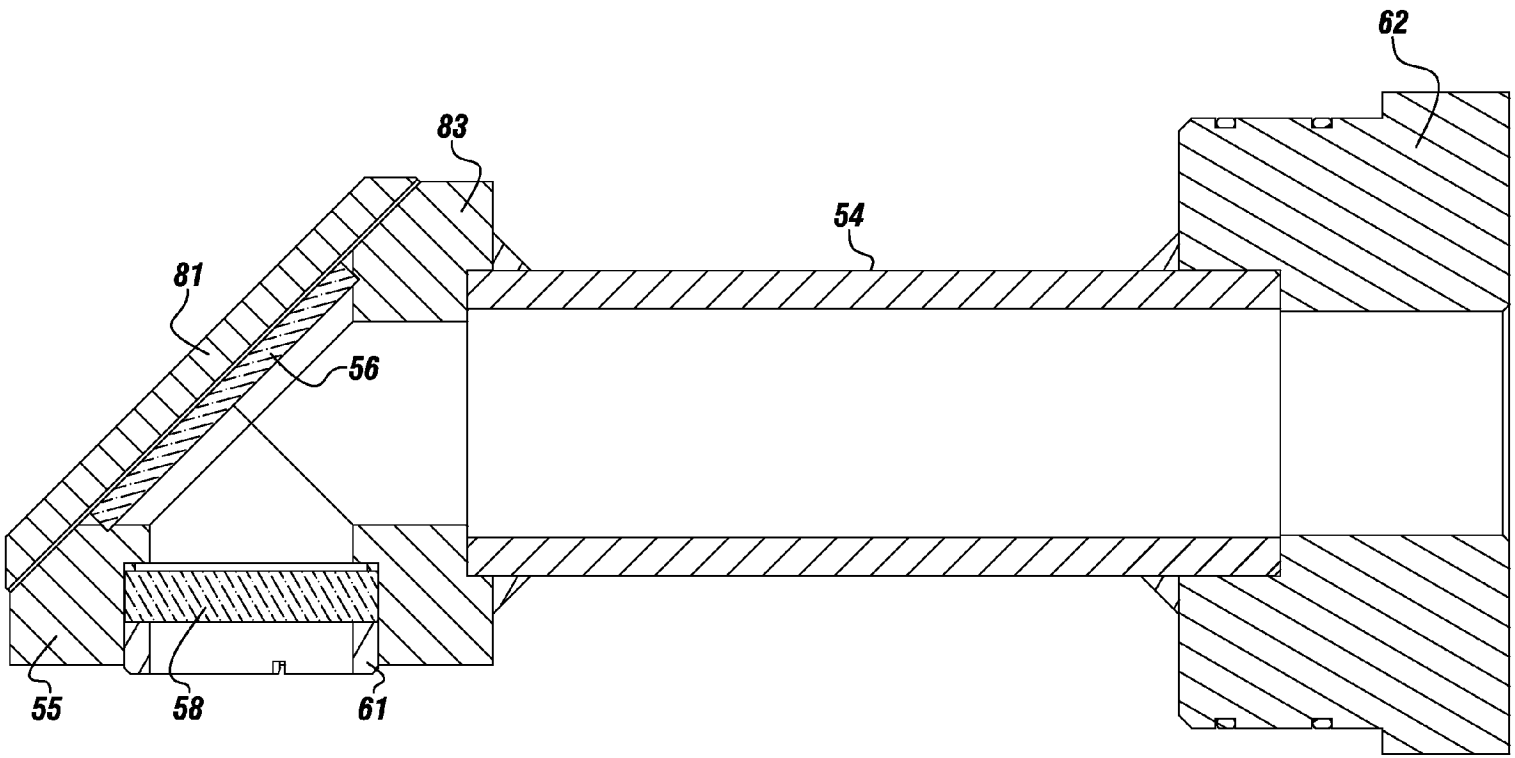
FIG. 5 is a cross sectional view of an optic guide.

FIG. 5 is a cross sectional view of an optic guide.

A lens 58 with a lens retainer 61 can be secured to the optics guide housing 55. The second re-directional surface 56 can be protected by a second external re-directional surface mounting cap 81. The second external re-directional surface mounting cap 81 can be placed over the second re-directional surface mount 83 and the second optic guide 54.

The optic guide can include a pressure isolation flange 62.

Figure 6:
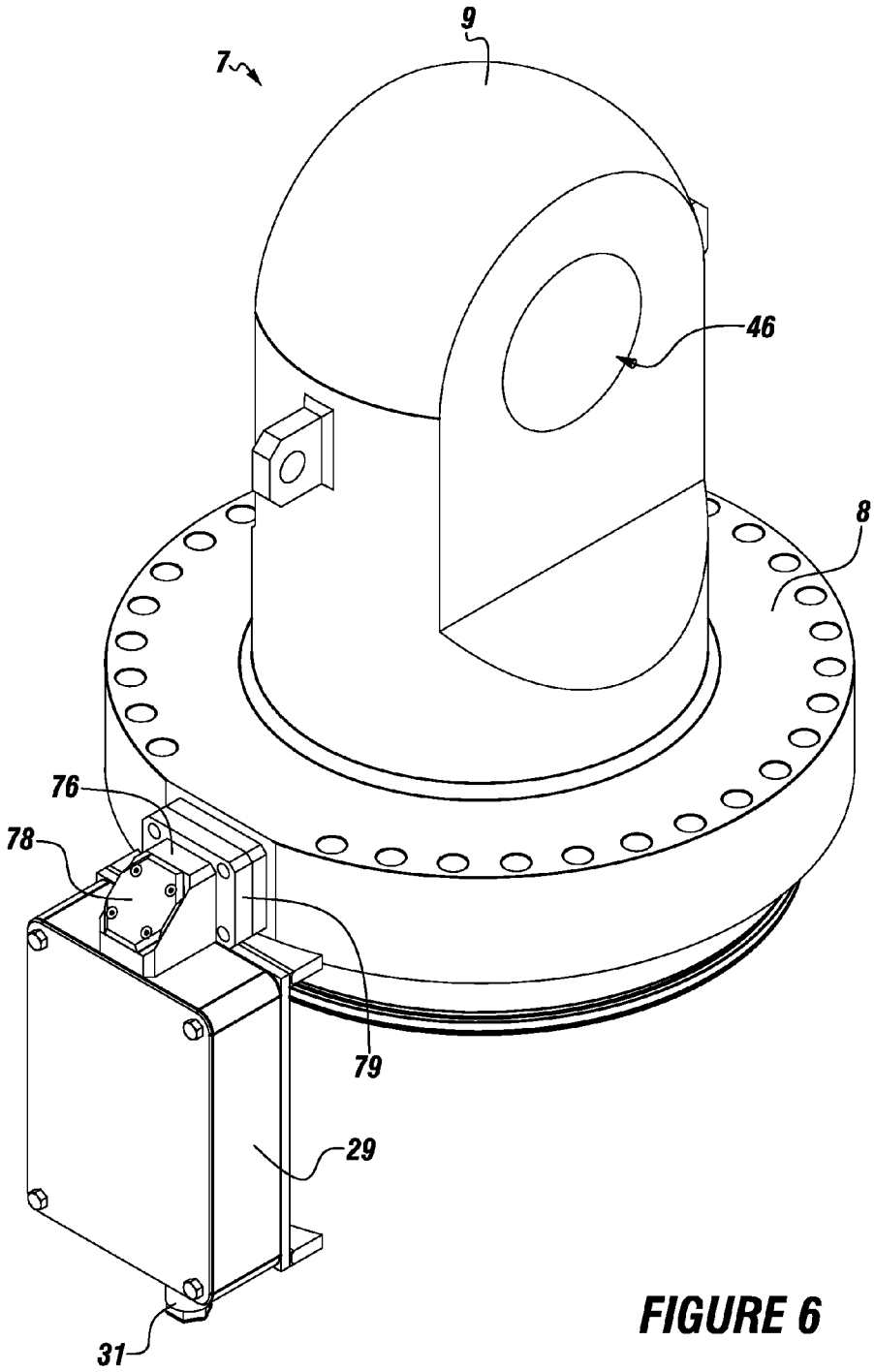
FIG. 6 is a perspective view of a blind end cap and mount.

FIG. 6 is a perspective view of a blind end cap and mount 7 to which the laser can be secured. The mount portion 9 can have a hole 46 for receiving a shackle pin. The mount portion 9 can secure to the cap portion 8.

Also shown are the laser housing 29 which can have the interface plug 31 that can completely surround the laser and the camera.

An external re-directional surface mount 76 can be connected to an external re-directional surface mounting cap 78 and a flange 79. The flange 79 can be used to attach the laser housing 29 to the pressure containing tube.

Figure 7:
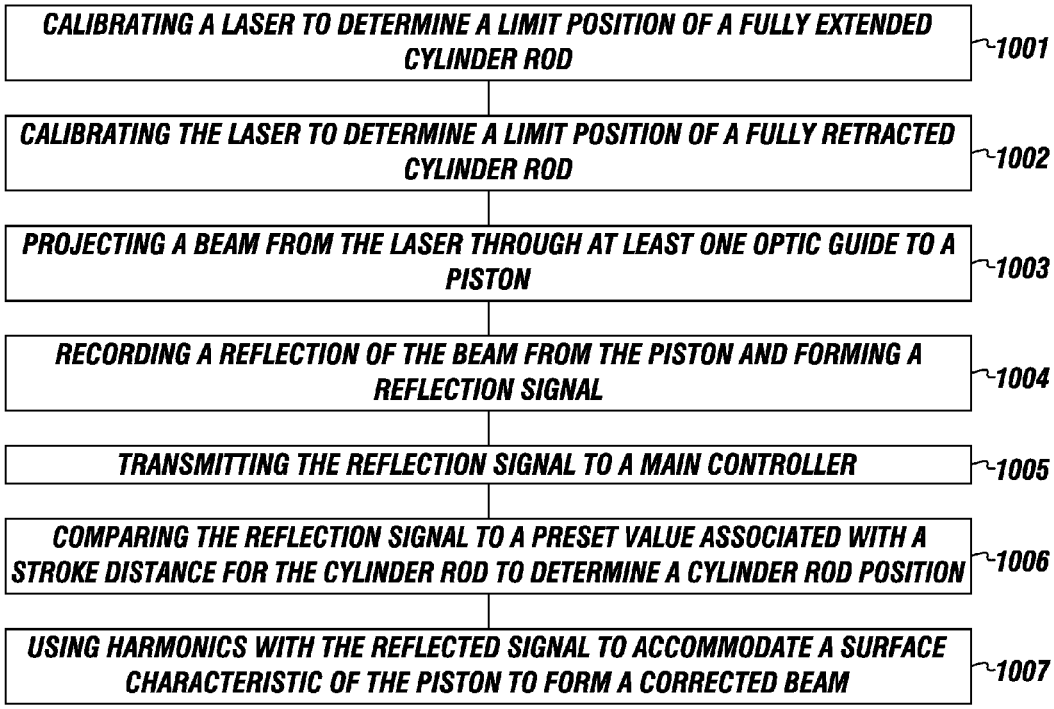
FIG. 7 is a diagram of a method for determining a position of a rod in a cylinder stroke system.

FIG. 7 depicts a flow chart of an embodiment of a method for determining a position of a rod in a cylinder stroke system.

The method can include calibrating a laser to determine a limit position of a fully extended cylinder rod, as illustrated by box 1001.

The method can include calibrating the laser to determine a limit position of a fully retracted cylinder rod, as illustrated by box 1002.

The method can include projecting a beam from the laser through at least one optic guide to a piston, as illustrated by box 1003.

The method can include recording a reflection of the beam from the piston and forming a reflection signal, as illustrated by box 1004.

The method can include transmitting the reflection signal to a main controller, as illustrated by box 1005.

The method can include comparing the reflection signal to a preset value associated with a stroke distance for the cylinder rod to determine a cylinder rod position, as illustrated by box 1006.

The method can include using harmonics with the reflected signal to accommodate a surface characteristic of the piston to form a corrected beam, as illustrated by box 1007.

Figure 8:
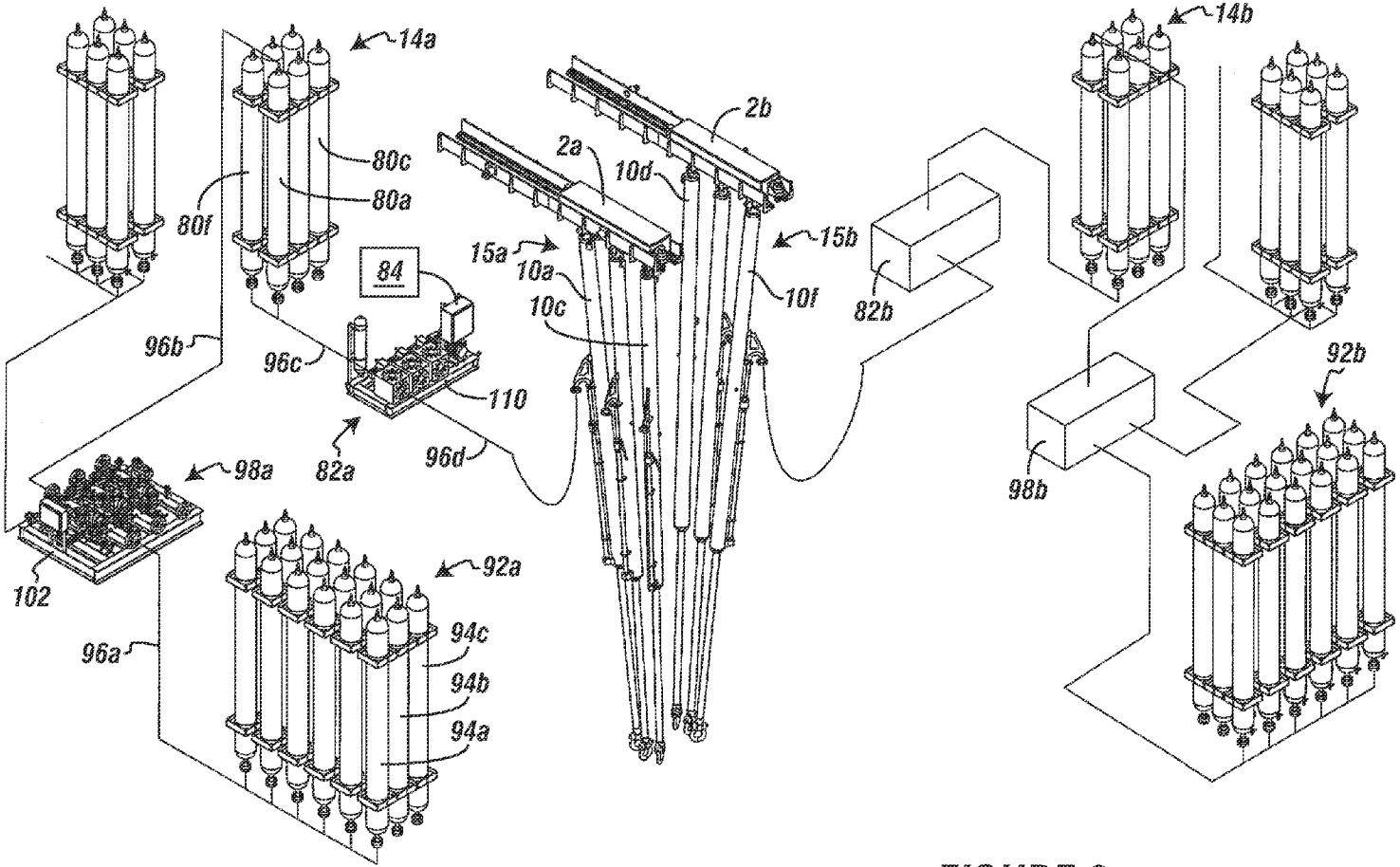
FIG. 8 is a perspective view of the tensioner assembly.

FIG. 8 is a perspective view of a tensioner assembly that can include: one or more sets of cylinder stroke systems including 15*a* and 15*b*, a first fluid source 14*a*, a second fluid source 14*b*, a first fluid source regulator 82*a*, a second fluid source regulator 82*b*, a first fluid source controller 84 in communication with the first fluid source regulator 82*a*, a first gas source 92*a*, a second gas source 92*b*, a first gas source regulator 98*a*, and a second gas source regulator 98*b*.

The sets of cylinder stroke systems 15*a* and 15*b* can be connected to a structure such as hangers 2*a* and 2*b*. The structure can be connected to a floating vessel or a stationary vessel.

The first gas source 92*a* can include one or more gas cylinders including 94*a*, 94*b*, and 94*c*. The gas cylinders 94*a*, 94*b*, and 94*c* can be in fluid communication with the first gas source regulator 98*a*. For example, a gas conduit 96*a* or tube can provide gas from the first gas source 92*a* to the first gas regulator 98*a*. The first gas regulator 98*a* can control the flow of gas to the first fluid source 14*a*, such as through gas conduit 96*b*. The first gas regulator 98*a* can be disposed on a control skid 102.

The first fluid source 14*a* can include one or more accumulators including 80*a*, 80*c*, and 80*f*. The accumulators 80*a*, 80*c*, and 80*f* can be connected in series and in fluid communication with the first fluid source regulator 82*a*.

The first fluid source controller 84 can actuate or regulate the first fluid source regulator 82*a*. The first fluid source controller 84 can control or regulate the flow of the first fluid from the first fluid source 14*a* to the cylinder stroke system 15*a*, such as through gas conduits 96*c* and 96*d*. The first fluid source regulator 82*a* can be disposed on a riser recoil skid 110.

The sets of cylinder stroke systems 15*a* and 15*b* can be connected to one or more risers. The risers can be connected to a well. For example, the risers can be connected to the wellhead of the well.

The cylinder stroke systems 15*a* and 15*b* are shown having pressure containing tubes 10*a*, 10*c*, 10*d*, and 10*f*.

Figure 9:
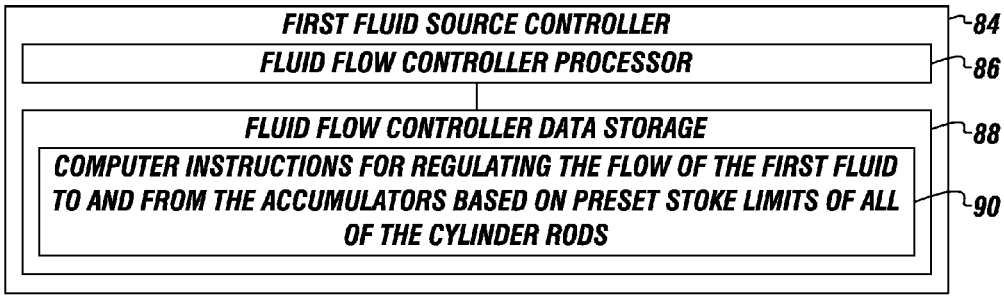
FIG. 9 is a detail of a fluid source controller.

FIG. 9 depicts a detail of the first fluid source controller 84. The first fluid source controller 84 can include a fluid flow controller processor 86, a fluid flow controller data storage 88, and computer instructions 90 stored in the fluid flow controller data storage 88 for regulating the flow of the first fluid to and from the accumulators based on preset stoke limits of all of the cylinder rods.

While these embodiments have been described with emphasis on the embodiments, it should be understood that within the scope of the appended claims, the embodiments might be practiced other than as specifically described herein.

What is claimed is:

1. A tensioner assembly comprising a plurality of cylinder stroke systems, wherein each cylinder stroke system comprises:

a. a pressure containing tube, wherein the pressure containing tube comprises a first tube end and a second tube end, and wherein the pressure containing tube comprises:

(i) a cylinder rod movably disposed within the pressure containing tube, wherein the cylinder rod comprises a cylinder rod first end and a cylinder rod second end;

(ii) a piston disposed on the cylinder rod first end;

(iii) a first fluid port formed in the pressure containing tube and in fluid communication with a first fluid source, wherein the first fluid port provides a first fluid to the pressure containing tube adjacent the cylinder rod, and wherein the first fluid source comprises a plurality of connected accumulators;

(iv) a second fluid isolated from the first fluid by the piston;

(v) a blind end cap and mount comprising a cap portion connected to the first tube end and a mount portion connected to the cap portion, wherein the mount portion connects to a component of a floating vessel linked to a subsea well;

(vi) a laser in communication with a laser controller, wherein the laser generates a beam, and wherein the beam causes a reflection from the piston;

(vii) at least one optic guide disposed through the first tube end for directing the beam from the laser, through the second fluid, and into contact with the piston, wherein the optic guides are hollow, and wherein the optic guides comprise an optic guide housing having a lens retainer holding a lens, and a re-directional surface operatively aligned with the lens, and an external re-directional surface mounting cap disposed at least partially about the re-directional surface;

(viii) a lens separating the at least one optic guide from the second fluid; and (ix) a camera in communication with the laser controller, a main controller, or combinations thereof, wherein the camera captures the reflection from the piston and converts the reflection into a reflection signal, and wherein the camera transmits the reflection signal to the main controller to determine a position of the cylinder rod in the pressure containing tube;

b. a first fluid source regulator for regulating fluid flow from the first fluid source to each of the cylinder stroke systems;

c. a first fluid source controller for controlling the first fluid source regulator, wherein the first fluid source controller comprises computer instructions for regulating flow of the first fluid to and from the plurality of connected accumulators based on a preset stroke limit for each of the cylinder rods within each pressure containing tube;

d. a first gas source connected to the first fluid source; and e. a first gas source regulator connected between the first fluid source and the first gas source for regulating gas flow from the first gas source to at least one of the plurality of accumulators.

2. The tensioner assembly of claim 1, wherein the plurality of connected accumulators are connected in series.

3. The tensioner assembly of claim 1, wherein the first gas source is a plurality of gas cylinders connected in series.

4. The tensioner assembly of claim 1, wherein a main controller is in communication with the laser controller, and wherein the main controller comprises computer instructions for instructing the laser controller to adjust the beam in view of preset data for each cylinder rod.

5. The tensioner assembly of claim 1, wherein the first fluid comprises a hydraulic fluid, air, or an inert gas.

6. The tensioner assembly of claim 1, wherein the second fluid comprises a vapor, an inert gas, or combinations thereof.

7. The tensioner assembly of claim 1, wherein the laser is external to the pressure containing tube.

8. The tensioner assembly of claim 1, further comprising a laser housing disposed about the laser and the camera.

9. The tensioner assembly of claim 1, wherein the re-directional surface is a prism, a mirror, a reflective plate, a lens, or combinations thereof.

10. The tensioner assembly of claim 1, wherein the beam has a constant frequency that is calibrated using computer instructions in the laser controller for providing a harmonic diagnostic procedure which adjusts to a composition of the second fluid.

11. The tensioner assembly of claim 1, further comprising a vapor diverter disposed on the at least one optic guide adjacent the lens for receiving any particles suspended in the second fluid.

12. The tensioner assembly of claim 1, further comprising a lens retainer disposed about the lens.

13. The tensioner assembly of claim 1, further comprising a pressure isolation flange connecting the at least one optic guide to the pressure containing tube.

14. The tensioner assembly of claim 4, wherein the main controller comprises:

a. a power supply;

b. a user interface display connected to the power supply;

c. a circuit board connected to the user interface display and the power supply;

d. a processor in communication with the circuit board; and e. a data storage in communication with the processor, wherein the data storage comprises:

(i) computer instructions for comparing the reflection signal to a preset value associated with a stroke distance for each cylinder rod in each pressure containing tube to determine a position of the piston in the pressure containing tube; and (ii) computer instructions for comparing the reflection signal to a preset velocity for the cylinder rod.

15. The tensioner assembly of claim 14, wherein the laser controller, the main controller, the first fluid source controller, and the first fluid source regulator are each in communication with at least one client device through a network for simultaneously transmitting information on each fluid source and the positions of each cylinder rod in each pressure containing tube from a remote location.

16. A method for determining a position of a rod in a cylinder stroke system, the method comprising:

a. calibrating a laser to determine a limit position of a fully extended cylinder rod in a pressure containing tube of a cylinder stroke system;

b. calibrating the laser to determine a limit position of a fully retracted cylinder rod in the pressure containing tube;

c. projecting a beam from the laser through at least one optic guide to a piston connected to the cylinder rod in the pressure containing tube, wherein the optic guides are hollow, and wherein the optic guides comprise an optic guide housing having a lens retainer holding a lens, and a re-directional surface operatively aligned with the lens, and an external re-directional surface mounting cap disposed at least partially about the re-directional surface;

d. recording a reflection of the beam from the piston using a camera connected to the laser and forming a reflection signal;

e. transmitting the reflection signal to a main controller; and f. using computer instructions to compare the reflection signal to a preset value associated with a stroke distance for the cylinder rod in the pressure containing tube to determine a cylinder rod position of the piston in the pressure containing tube.

17. The method of claim 16, further comprising using harmonics with the reflected signal to accommodate a surface characteristic of the piston to form a corrected beam.

18. The method of claim 16, wherein the main controller is in communication with at least one client device through a network for simultaneous monitoring of the cylinder stroke system.

* * * * *